US009744423B1

(12) United States Patent
Conner

(10) Patent No.: US 9,744,423 B1
(45) Date of Patent: Aug. 29, 2017

(54) GOLF SWING TRAINING DEVICE

(71) Applicant: Mitchell Conner, Chili, WI (US)

(72) Inventor: Mitchell Conner, Chili, WI (US)

( * ) Notice: Subject to any disclaimer, the term of this patent is extended or adjusted under 35 U.S.C. 154(b) by 0 days.

(21) Appl. No.: 15/358,292

(22) Filed: Nov. 22, 2016

(51) Int. Cl.
*A63B 69/36* (2006.01)

(52) U.S. Cl.
CPC ..... *A63B 69/36* (2013.01)

(58) Field of Classification Search
USPC ..... 473/215, 226, 227, 231, 234, 238, 257
See application file for complete search history.

(56) References Cited

U.S. PATENT DOCUMENTS

| | | | | |
|---|---|---|---|---|
| 5,184,825 | A | 2/1993 | Ruth | |
| 5,415,406 | A | 5/1995 | Reichenbach | |
| 6,551,197 | B1 * | 4/2003 | Travo | A63B 69/3676 473/258 |
| 7,004,850 | B1 | 2/2006 | Hong | |
| 7,285,055 | B2 | 10/2007 | Radle | |
| 7,766,761 | B2 | 8/2010 | Cayse | |
| 7,883,429 | B1 * | 2/2011 | Chen | A63B 69/365 473/229 |
| 8,591,349 | B1 * | 11/2013 | Jones | A63B 69/3644 473/229 |
| 8,696,485 | B2 | 4/2014 | Pies | |
| D709,977 | S | 7/2014 | Mills | |
| 8,894,503 | B2 * | 11/2014 | Dandrea | A63B 69/0057 473/226 |
| 9,162,131 | B1 * | 10/2015 | Watson | A63B 69/0057 |
| 2012/0258816 | A1 * | 10/2012 | Celone | A63B 21/0088 473/228 |
| 2016/0038819 | A1 * | 2/2016 | Daniel | A63B 69/3685 473/238 |

FOREIGN PATENT DOCUMENTS

| | | | |
|---|---|---|---|
| WO | 9309855 | A1 | 5/1993 |

* cited by examiner

*Primary Examiner* — Nini Legesse
(74) *Attorney, Agent, or Firm* — Kyle A. Fletcher, Esq.

(57) ABSTRACT

The golf swing training device is a device that can be attached to a golf club. It provides an easily seen visual indication of when the clubface is perpendicular to the direction that the clubface is traveling. When used in conjunction with instructional material the golf swing training device can assist a golfer in correcting a bad swing and it can assist a golf instructor in demonstrating proper swing technique.

13 Claims, 6 Drawing Sheets

GOLF SWING TRAINING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of training aids, more specifically, golf swing training devices.

In the sport of golf, proper technique for hitting the golf ball requires that the clubface is perpendicular to the direction that the clubface is traveling at the moment that the clubface hits the ball (in golf terminology, this orientation is known as "square clubface"). If the clubface is not held in this orientation at the bottom of the swing (and instead is twisted slightly one way or the other) a slice or a hook may result. A slice or hook may cause the golf ball to travel farther to the right or left than intended. Because the clubface is relatively small and is moving rapidly during a swing, it is difficult for golfers to observe this alignment during a swing, and it is orientation of the clubface at the bottom of the swing. What is needed is a way of visualizing whether the clubface is 'square' at the bottom of a golf swing.

SUMMARY OF INVENTION

The golf swing training device is a device that can be attached to a golf club. The golf swing training device provides an easily seen visual indication of when the clubface is perpendicular to the direction that the clubface is traveling. When used in conjunction with instructional material, the golf swing training device can assist a golfer in correcting a bad swing and it can assist a golf instructor in demonstrating proper swing technique.

An object of the invention is to provide an aid for use with a golf club, which allows proper orientation of the clubface during a swing to be easily visualized.

This together with additional objects, features and advantages of the golf swing training device will be readily apparent to those of ordinary skill in the art upon reading the following detailed description of the presently preferred, but nonetheless illustrative, embodiments when taken in conjunction with the accompanying drawings.

In this respect, before explaining the current embodiments of the golf swing training device in detail, it is to be understood that the golf swing training device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the golf swing training device.

It is therefore important that the claims be regarded as including such equivalent construction insofar as they do not depart from the spirit and scope of the golf swing training device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. As used herein, the word "or" is intended to be inclusive. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
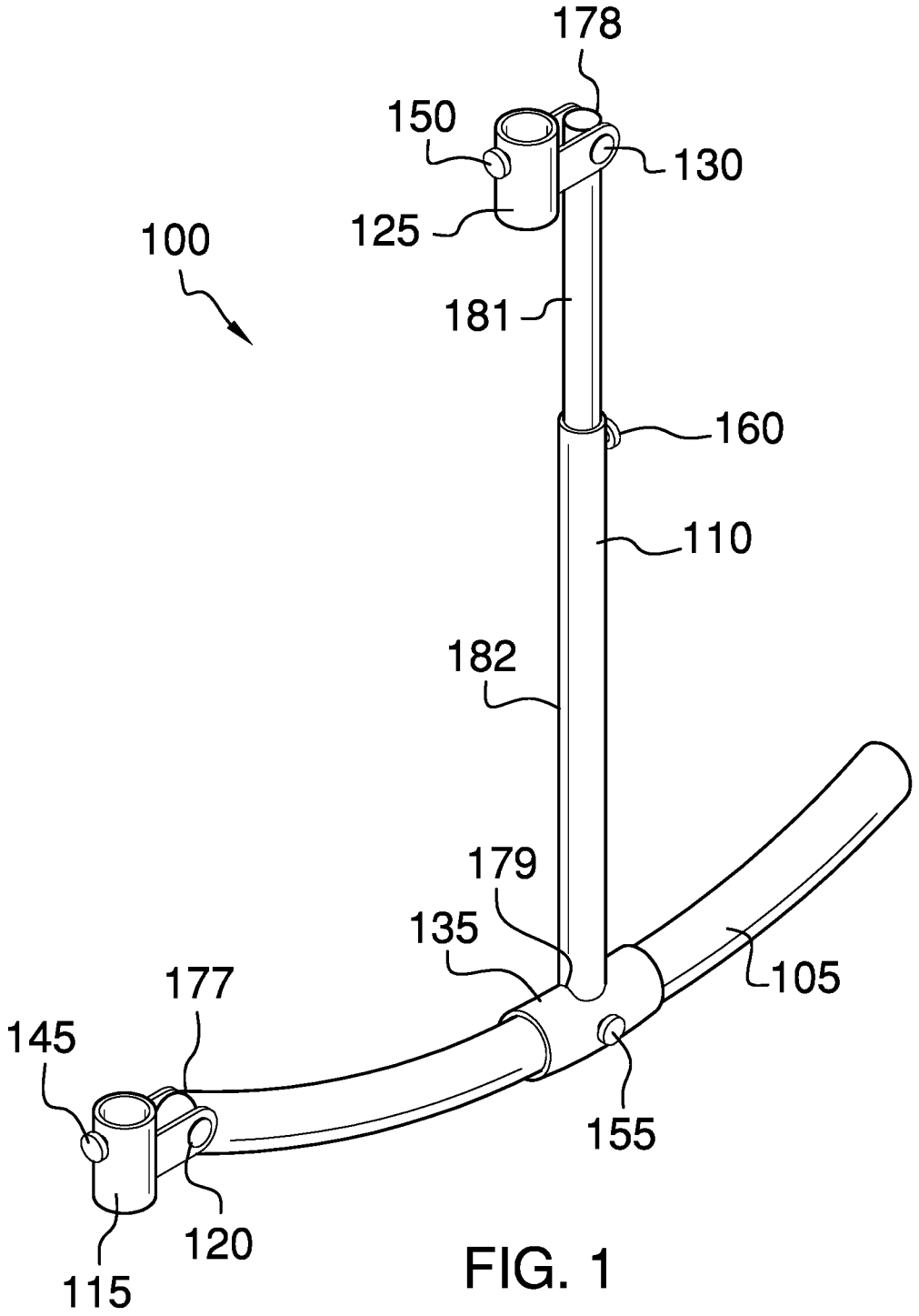
FIG. 1 is a perspective view of an embodiment of the disclosure.
Figure 2:
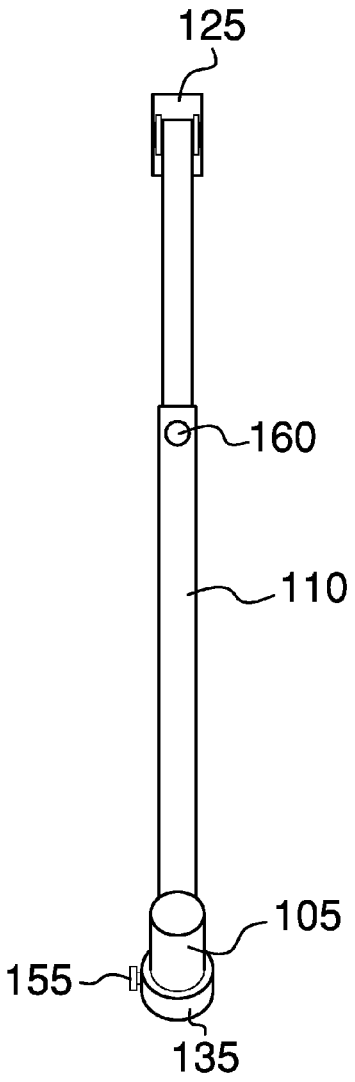
FIG. 2 is a front view of an embodiment of the disclosure.
Figure 3:
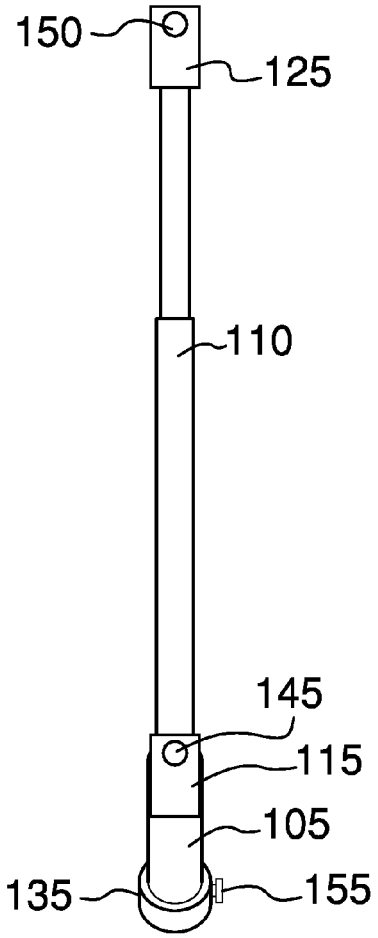
FIG. 3 is a rear view of an embodiment of the disclosure.
Figure 4:
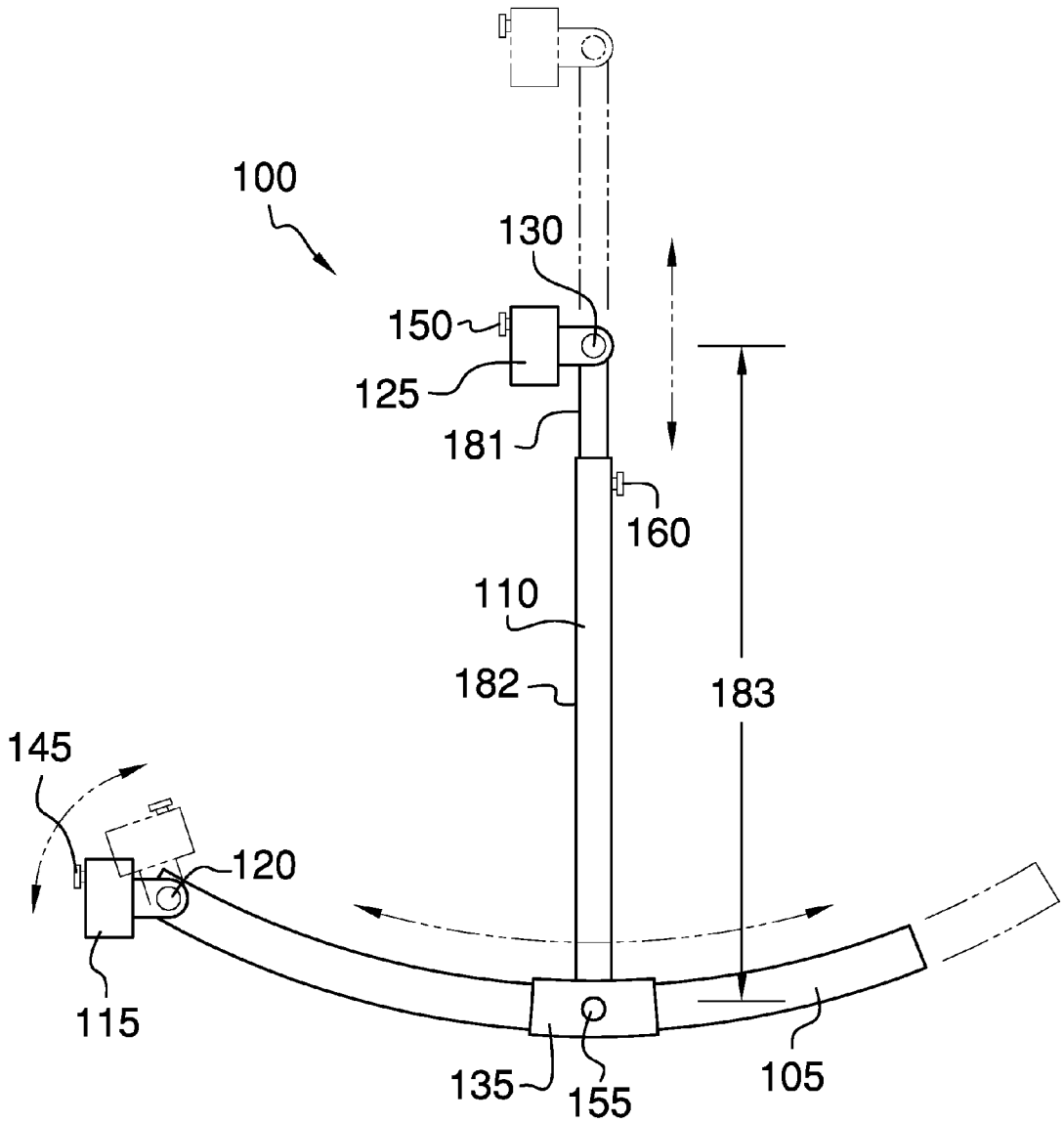
FIG. 4 is a side view of an embodiment of the disclosure illustrating several adjustment points.
Figure 5:
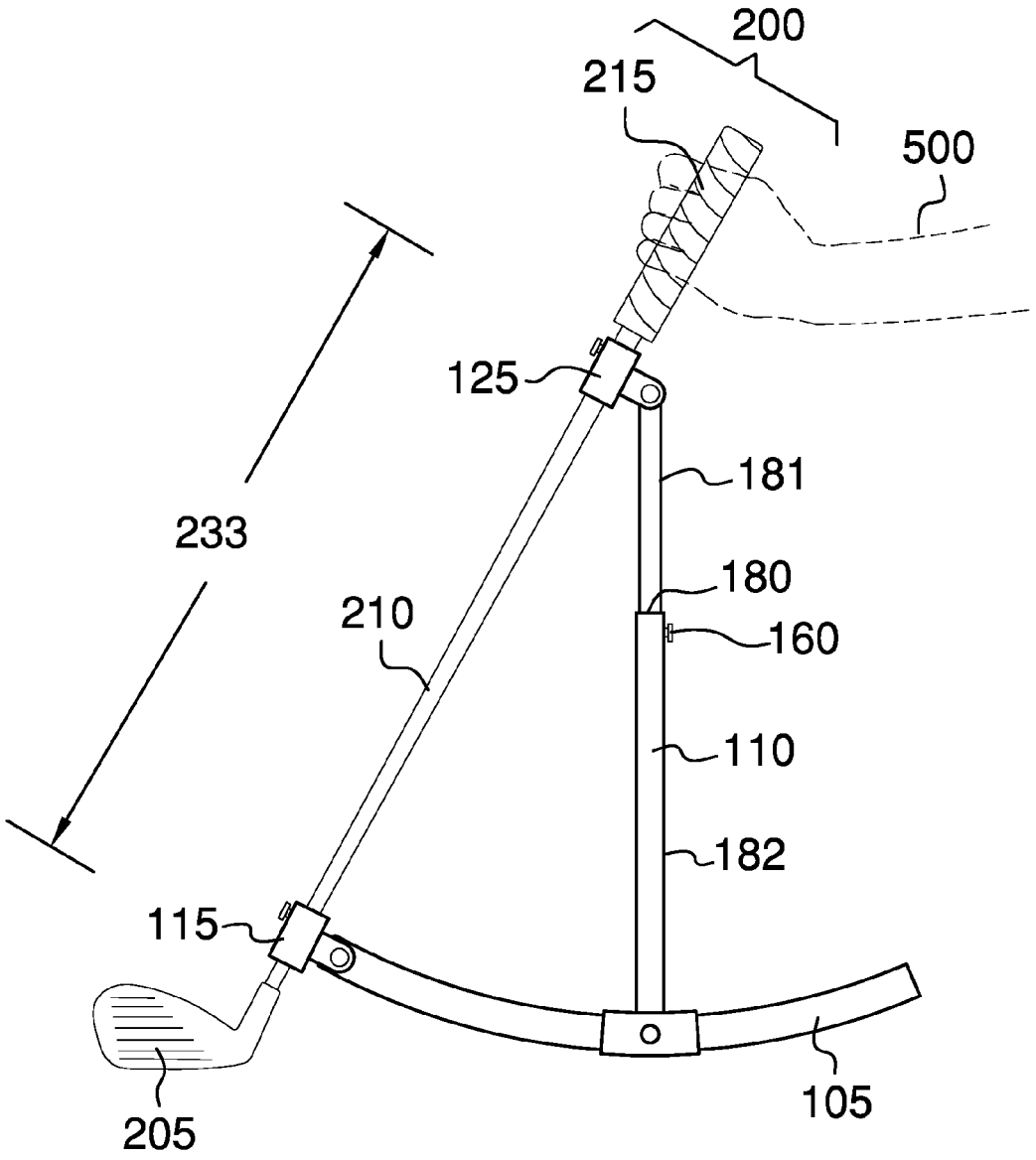
FIG. 5 is a side view of an embodiment of the disclosure attached to a golf club.
Figure 6A:
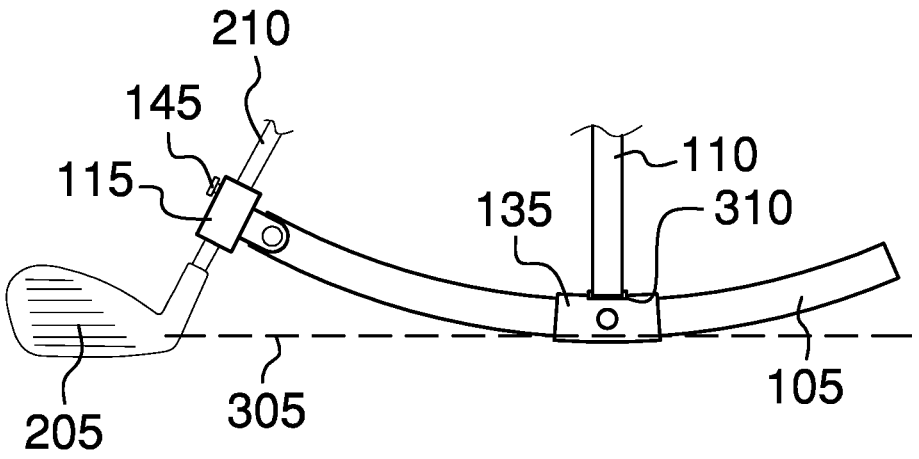
FIG. 6A shows a detail of an embodiment of the disclosure.
Figure 6B:
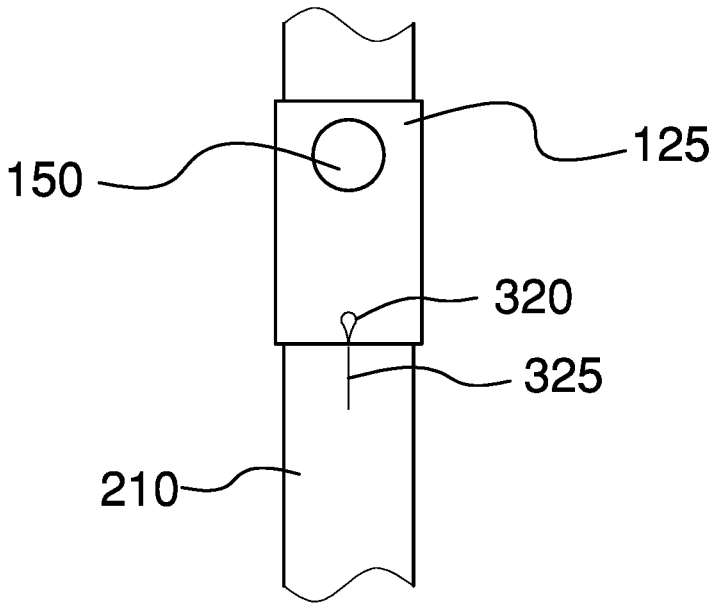
FIG. 6B shows another detail of an embodiment of the disclosure.
Figure 7:
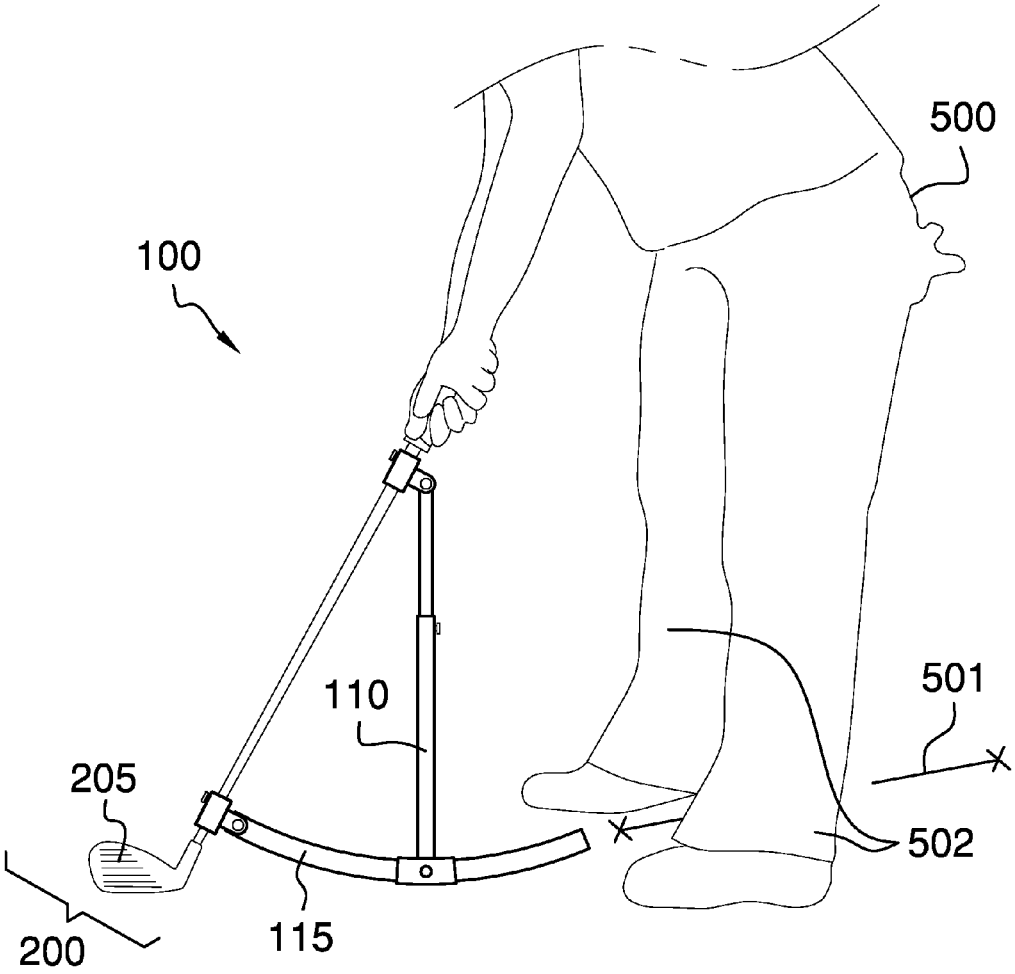
FIG. 7 is a perspective view of an embodiment of the disclosure in use.

Detailed reference will now be made to a first potential embodiment of the disclosure, which is illustrated in FIGS. 1 through 7.

The golf swing training device 100 (hereinafter invention) comprises a first armature 105, a second armature 11, a first collar 115, and a second collar 125. The first armature 105 is curved and substantially horizontal. The second armature 110 is straight and vertical. Moreover, both the first armature 105 and the second armature 110 may be made of tubular construction. The first collar 115 is connected to a first end 177 of the first armature 105 via a first hinge 120. The second collar 125 is connected to a second end 178 of the second armature 110 via a second hinge 130. The invention 100 includes a third collar 135 that is connect to a third end 179 of the second armature 110. Moreover, the first armature 105 passes through the third collar 135.

Each of the three collars (first collar 115, the second collar 125, and the third collar 135) provides a first lock screw 145, a second lock screw 150, and a third lock screw 155 (respectively) to hold the respective collar in place. The first collar 115 and lock screw 145 and the second collar 115 and lock screw 150 are provided as a means of attaching the invention 100 to a shaft 210 of a golf club 200.

The material used to construct the invention 100 is not critical except that it should be lightweight and stiff enough not to bend easily. In some embodiments the cost of the material may be a consideration. Non-limiting examples of materials suitable for constructing the invention may include aluminum, titanium, steel, fiberglass, plastic, or a combination of these.

In the preferred embodiment, the coloring of the first armature 105 is selected to promote high visibility and the coloring of the second armature 110 is selected to promote lower visibility. For example, the first armature 105 may be red, fluorescent orange, or white while the second armature 110 is silver (to match the color of an attached golf club).

In operation, the invention 100 is prepared for use by attaching it to the golf club 200. The invention 100 is attached to the golf club 200 by loosening the first lock screw 145, the second lock screw 150, and the third lock screw 155. Next, the first collar 115 is configured to be slid onto the shaft 210 of the golf club 200. Next, the second collar 125 is configured to be slid onto the shaft 210 of the golf club and the invention 100 is positioned so that the first collar 115 is configured to be positioned just above a head 205 of the golf club 200. The invention 100 must then be aligned properly before any of lock screws (the first lock screw 145, the second lock screw 150, and the third lock screw 155) are tightened. When the invention 100 is aligned, the first lock screw 145 on the first collar 115 is tightened. Finally, the second lock screw 150 on the second collar 125 and the third lock screw 155 on the third collar 135 are tightened, respectively. While the drawings illustrate collars that wrap completely around the shaft 210 of the golf club 200, those skilled in the art will recognize that other types of collars may be used without limiting the scope of the claims.

In some embodiments, the second armature 110 may be telescoping in nature and may provide a telescoping lock screw 160 to secure a telescoping joint 180. The second armature 110 may be further defined with a first telescoping member 181 and a second telescoping member 182. The first telescoping member 181 slides into and from the second telescoping member 182 in order to adjust a telescoping length 183. In this scenario, the second armature 110, in combination with the first hinge 120 and second hinge 130, allows for the geometry of the invention 100 to be adjusted to match a length 233 of the shaft 210 of the golf club 200 and an applicable height of a golfer 500. While adjusting the geometry, the telescoping lock screw 160 on the telescoping joint 180, and the third lock screw 155 on the third collar 135 are loosened, and both the first hinge 120 and second hinge 130 are allowed to re-orient. Simultaneously, the third collar 135 may be moved to a different position on the first armature 105 in order to retain a vertical orientation of the second armature 110. When the height adjustment is complete the third lock screws 155 and the telescoping lock screw 160 are each tightened.

When the invention 100 is properly aligned, the first armature 105 will point directly back at a central axis 501 between a golfer's legs 502 when the clubface 205 is square. Because the first collar 115 and second collar 125 can revolve around the shaft 210 of the golf club 200, the invention 100 cannot be assumed to be properly aligned when it is first placed on the golf club 200. Instructional material provided with the invention 100 explains the specific alignment process. The invention does not preclude that the alignment process relies on visual alignment 305 of a portion of the clubface 205 with a portion of the first armature 105 or with a first alignment mark 310 on the third collar 135 (see FIGS. 6A and 6B). Neither does the invention 100 preclude that the alignment process relies on the use of an alignment jig (not shown). An alignment jig is defined as an inexpensive template, which, optionally touches both the clubface 205 and the first armature 105 in a specific manner only when the invention 100 is properly aligned. The invention 100 also does not preclude that the alignment process relies on aligning a second alignment mark 320 on some portion of the invention 100 such as the second collar 125 with a third alignment mark 325 on the shaft 210 or other portion of certain golf clubs. Other alignment processes not described here may also be possible.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A golf swing training device comprising:
a first armature and a second armature;
wherein the first armature is configured to attach to a golf club;
wherein the second armature is configured to attach to said golf club;
wherein the first armature is slideably engaged with respect to the second armature;
wherein the first armature is adapted to extend towards a golfer in order to provide a visual indication that a club face of said golf club is square at a moment of impact with a golf ball;
wherein the first armature is curved and substantially horizontal;
wherein the second armature is straight and vertical;
wherein the first armature and the second armature are of tubular construction;
wherein a first collar is connected to a first end of the first armature via a first hinge.

2. The golf swing training device according to claim 1 wherein a second collar is connected to a second end of the second armature via a second hinge.

3. The golf swing training device according to claim 2 wherein a third collar is connected to a third end of the second armature; wherein the first armature passes through the third collar.

4. The golf swing training device according to claim 3 wherein the first armature, the second armature, and the golf club form a three-sided apparatus.

5. The golf swing training device according to claim 4 wherein the first collar includes a first lock screw; wherein the second collar includes a second lock screw; wherein the third collar includes a third lock screw; wherein the first lock screw of the first collar as well as the second lock screw of the second collar are configured to secure the golf swing training device to a shaft of said golf club.

6. The golf swing training device according to claim 5 wherein the golf swing training device is attached to the golf club by loosening the first lock screw, the second lock screw, and the third lock screw; wherein the first collar is configured to be slid onto the shaft of the golf club; wherein the second collar is configured to be slid onto the shaft of the golf club, and the golf swing training device is positioned so that the first collar is configured to be positioned just above a head of the golf club; wherein the first lock screw, the second lock screw, and the third lock screw are tightened.

7. The golf swing training device according to claim 6 wherein the second armature is further defined with a telescoping lock screw that is provided to secure a telescoping joint.

8. The golf swing training device according to claim 7 wherein the second armature is further defined with a first telescoping member and a second telescoping member; wherein the first telescoping member slides into and from the second telescoping member in order to adjust a telescoping length.

9. The golf swing training device according to claim 8 wherein the second armature, in combination with the first hinge and second hinge, allows for the geometry of the golf swing training device to be configured to adjust to a length of the shaft of the golf club and an applicable height of said golfer; wherein the telescoping lock screw on the telescoping joint, and the third lock screw on the third collar are loosened, and both the first hinge and second hinge are allowed to re-orient.

10. The golf swing training device according to claim 9 wherein the third collar is able to be moved to a different position on the first armature in order to retain a vertical orientation of the second armature.

11. The golf swing training device according to claim 10 wherein once the golf swing training device is properly aligned, the first armature will point directly back at a central axis between a golfer's legs when the clubface is square.

12. The golf swing training device according to claim 11 wherein visual alignment of a portion of the clubface is compared with a portion of the first armature or with a first alignment mark on the third collar.

13. The golf swing training device according to claim 12 wherein a second alignment mark on the second collar is used to align with a third alignment mark on the shaft of the golf club to align the clubface with the first armature.

* * * * *